United States Patent [19]

Behlau

[11] 4,235,286

[45] Nov. 25, 1980

[54] HEAT RECLAIMING FLUE PIPE

[76] Inventor: Adolph Behlau, 331 Monroe Ave., Cherry Hill, N.J. 08002

[21] Appl. No.: 19,307

[22] Filed: Mar. 9, 1979

[51] Int. Cl.[3] ..... F28D 7/02

[52] U.S. Cl. ..... 165/164; 165/DIG. 2; 165/DIG. 13; 237/55

[58] Field of Search ..... 126/307; 165/DIG. 2, 165/DIG. 13, 95, 164; 34/86; 237/55

[56] References Cited

U.S. PATENT DOCUMENTS

| | | | |
|---|---|---|---|
| 645,611 | 3/1900 | Wait | 165/95 |
| 674,918 | 5/1901 | Hebden | 165/95 |
| 4,078,602 | 3/1978 | Richer | 165/DIG. 2 |

*Primary Examiner*—James C. Yeung
*Attorney, Agent, or Firm*—Duffield & Lehrer

[57] ABSTRACT

A heat reclaiming flue pipe is comprised of a section of standard flue pipe of standard diameter and length. A plurality of metal pipes pass through the interior of the flue pipe section and are arranged in alignment with one another. Hot flue gases and smoke heat the plurality of metal pipes which in turn heat the air within the metal pipes. The heated air passes from the ends of the pipes into the room where the flue is located. Any number of heat reclaiming flue pipes may be utilized in the flue system.

1 Claim, 4 Drawing Figures

HEAT RECLAIMING FLUE PIPE

BACKGROUND OF THE INVENTION

The present invention is directed toward a heat reclamation flue pipe and more particularly to a new type of flue pipe which is directly interchangeable with standard flue pipe sections presently in use today but which reclaims a portion of the heat from the hot flue gases and smoke which otherwise would be lost through the chimney and up into the atmosphere. The heat reclaiming flue pipe of the present invention is simple and inexpensive so that any number of them may be used in a given installation so that the desired amount of heat may be reclaimed for heating the room in which the flue is located.

As is well-known in the art, furnaces and stoves for heating buildings by means of fuel such as gas, oil, wood, coal or the like are only moderately efficient since a large amount of the heat energy available from the combustion of the fuel is wasted in the hot gases which pass through the flue system and up the chimney. Thus, it has been found in many installations that the temperature in the smoke or flue pipe leading out of the furnace and to the chimney is as great as about 750° Fahrenheit indicating that considerable waste heat is present in the flue gases.

Numerous devices have been proposed for extracting some of the wasted heat from the flue pipe to directly or indirectly complement the usual heating effort of the heating system and to thus attempt to increase the total heating efficiency of the system. These prior devices, however, all suffer from substantially the same deficiencies. All prior devices known to Applicant are relatively complex arrangements which can only be added to the existing flue system by making various modifications thereto. This makes these prior devices relatively expensive and difficult to install particularly when electrical power must be provided for the blowers which are needed in these prior devices. Because of the relatively high cost of prior art heat reclaiming devices, it is impractical to utilize more than one such device in any flue system and accordingly, only a limited amount of heat can be reclaimed from the flue pipe system.

SUMMARY OF THE INVENTION

The present invention overcomes the above-described deficiencies of prior art devices by providing a heat reclaiming flue pipe which is comprised of a section of standard flue pipe of standard diameter and length. A plurality of metal pipes pass through the interior of the flue pipe section and are arranged in alignment with one another. Hot flue gases and smoke heat the plurality of metal pipes which in turn heat the air within the metal pipes. The heated air passes from the ends of the pipes into the room where the flue is located. Any number of heat reclaiming flue pipes may be utilized in the flue system.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
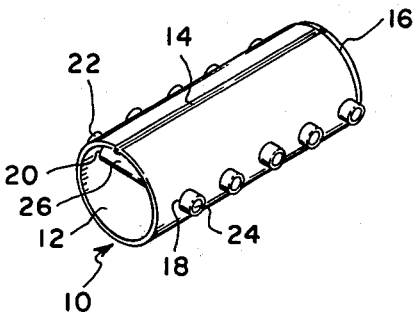
FIG. 2 is a single section of a heat reclaiming flue pipe constructed in accordance with the principles of the present invention.

Referring now to the drawings in detail wherein like reference numerals have been used throughout the various figures to designate like elements, there is shown in FIG. 2 a perspective view of a heat reclaiming flue pipe constructed in accordance with the principles of the present invention and designated generally as 10.

Heat reclaiming flue pipe 10 is comprised of a section 12 of a standard flue pipe of standard diameter and length. Standard length of a flue pipe section is normally two or four feet and the standard diameter is either six or eight inches. Flue pipe section 12 is constructed of sheet metal bent into cylindrical form as is well-known in the art. A seam 14 running the length of the section 12 maintains the piece of sheet metal in cylindrical form. As is also well-known in the art, flue pipe section 12 normally has a reduced diameter portion 16 at one end thereof which allows the pipe section 12 to be connected to other similar pipe sections or to the furnace, stove or chimney etc.

Formed in the walls of the cylindrically shaped sheet metal flue pipe section 12 are a plurality of substantially circular holes 18 on one side thereof and 20 on the opposite side. For each hole 18, there is a complementary hole 20 which is in alignment therewith but which is spaced therefrom by 180°. In the embodiment of the invention shown in FIG. 2, there are five holes 18 and five complementary holes 20 all of which are in alignment with each other. It should be understood, however, that this is by way of example only and that a fewer or greater number of holes 18 and 20 may be provided if desired.

Inserted into and through each hole 18 in complementary hole 20 is a metal pipe 22. Each metal pipe 22 is substantially hollow and is open at each end thereof such as shown at 24 but has a solid cylindrical wall 26.

Figure 1:
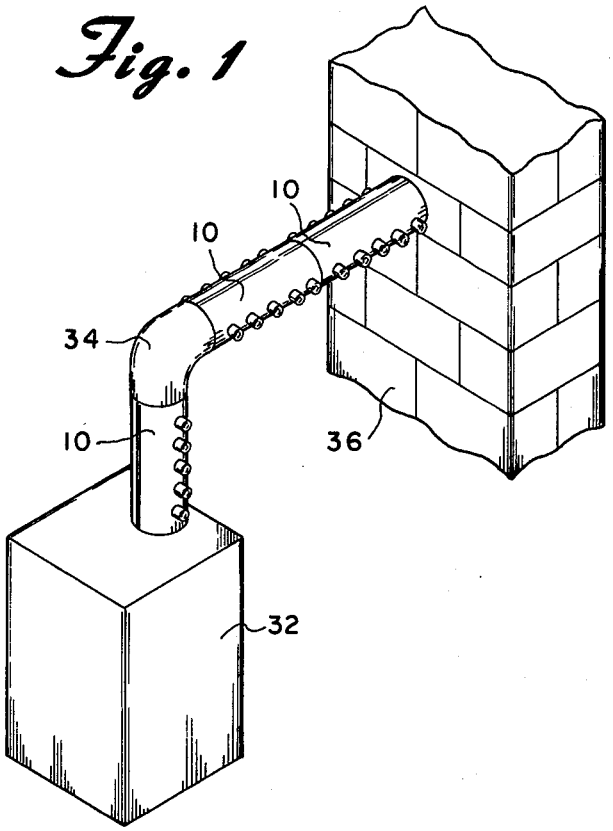
FIG. 1 is an overall perspective view of a furnace, flue system and chimney showing the use of several heat reclaiming flue pipes of the present invention.

The outside diameter of each of the metal pipes 22 is substantially equal to the diameter of the holes 18 and 20 so that a substantially airtight seal is formed between the pipes 22 and the flue pipe section 12 when the pipes 22 are inserted therein. In addition, the length of each of the metal pipes 22 is slightly greater than the outside diameter of the flue pipe section 12. Thus, when each pipe 22 is inserted through hole 18 and complementary hole 20, the metal pipe 22 passes through the interior of flue pipe section 12 and extends outwardly through the sides thereof i.e. through holes 18 and 20, by a very small amount as shown in FIGS. 1 and 2. As should also be apparent from FIGS. 1 and 2, when the plurality of metal pipes 22 are inserted in the flue pipe section 12, they are in substantial alignment with one another.

Figure 3:
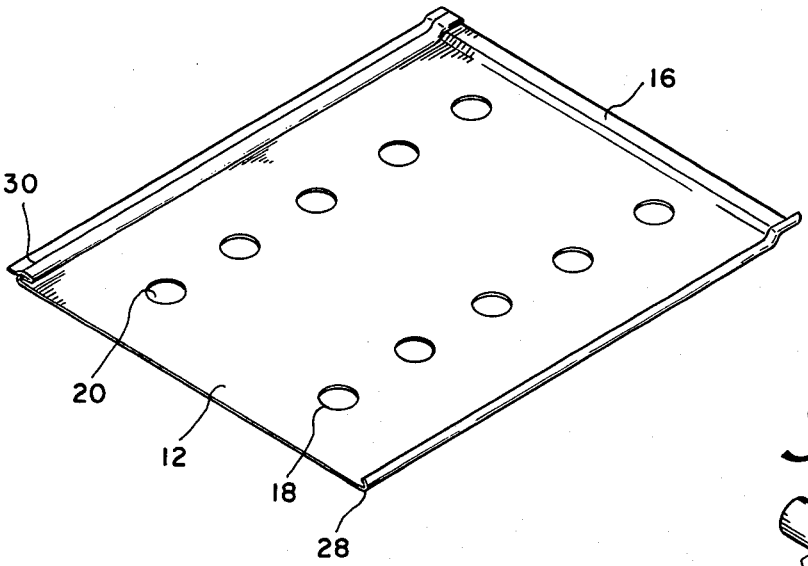
FIG. 3 is a perspective view of a piece of sheet metal used in constructing the present invention.

As shown in FIG. 3, the heat reclaiming flue pipe of the present invention is constructed from a substantially flat piece of sheet metal. The two longitudinal edges thereof are bent or folded over such as shown at 28 and 30 so that when the sheet metal is rolled into cylindrical form the edges 28 and 30 join together to form the seam 14 (FIG. 2). Similarly, one end of the piece of sheet metal is bent or deformed so as to form the reduced diameter portion 16.

The piece of sheet metal just described and used to form the flue pipe section 12 of the present invention is well-known in the art in that the same has been used for many years in forming conventional flue pipe sections. In accordance with the present invention, however, the piece of sheet metal is further provided with a plurality of holes 18 and a plurality of holes 20, the purpose of which having been described in detail above. In other words, while the holes 18 and 20 could be formed in the flue pipe section 12 after the same has been bent into cylindrical form, the holes can be formed much more easily and economically by stamping them out of the sheet metal when the same is still in a substantially flat shape.

Figure 4:
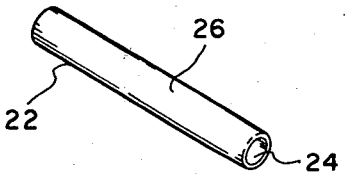
FIG. 4 is a perspective view of one of the metal pipes which is combined with the sheet metal of FIG. 3 in constructing the present invention.

Similarly, while the heat reclaiming flue pipe 10 of the present invention and as shown in FIG. 2 could be totally formed at a factory, it should be readily apparent to those skilled in the art that shipping and production costs could be greatly reduced by shipping the preformed sheet metal pieces shown in FIG. 3 and a plurality of metal pipes 22 (FIG. 4) in an unassembled condition. In this way, the retailer, the contractor or the ultimate consumer can then bend the sheet metal into the cylindrical form as has been done in the past with conventional flue pipe sections and can then insert the plurality of metal pipes 22 in accordance with the present invention to form a finished heat reclaiming flue pipe 10.

The manner in which the heat reclaiming flue pipe 10 of the present invention is used is shown in FIG. 1. In the heating system shown in FIG. 1, a fuel burning furnace 32 is shown connected through several flue pipe sections and an elbow 34 to a chimney 36. It should be readily apparent that the illustration of a furnace 32 is by way of example only and that the present invention could also be utilized with a wood or coal burning stove or substantially any other device which utilizes a flue. Similarly, the use of a chimney 36 is by way of example only and that in some installations the flue pipe itself continues upwardly to the atmosphere rather than through a chimney.

In the example shown in FIG. 1, substantially all of the wasted heat which could be removed from the otherwise wasted heated flue gases is reclaimed since all of the straight flue pipe sections are heat reclaiming flue pipes 10 constructed in accordance with the principles of the present invention. Thus, the hot flue gases immediately leaving the furnace 32 heat the plurality of metal pipes 22 as the flue gases move upwardly. In turn, the air within the metal pipes 22 (which air is totally isolated from the flue gases) is heated and by convention currents passes out of the openings 24 of the metal pipes 22 to heat the room where the furnace and flue is located. Since the remaining flue pipe sections are heat reclaiming flue pipes 10, similar activity takes place as the flue gases continue toward and enter the chimney 36.

As should be readily apparent to those skilled in the art, there may be some installations where it might not be desirable or necessary to remove so much heat from the flue gases. Thus, in some installations it might be desirable to utilize conventional flue pipe sections along with one or more heat reclaiming flue pipes 10. In other words, referring to FIG. 1, it might be desirable to use only two rather than three heat reclaiming flue pipes 10 and to utilize a conventional flue pipe as the third section needed to complete the flue system. This can easily be accomplished with the present invention since the heat reclaiming flue pipe 10 and conventional flue pipes are directly interchangeable with each other. In other words, with the present invention any number of heat reclaiming flue pipes 10 and any number of conventional flue pipes and any combinations thereof may be used as desired. This can be done with the present invention in view of the simplicity and therefore relatively low cost of the heat reclaiming flue pipe 10. The use of more than one prior art heat reclaiming device, however, is not practical in view of the high cost thereof.

The present invention may be embodied in other specific forms without departing from the spirit or essential attributes thereof and, accordingly, reference should be made to the appended claims rather than to the foregoing specification as indicating the scope of the invention.

I claim:

1. A heat reclaiming flue pipe comprising:

a cylindrically shaped sheet metal flue pipe section of standard diameter and length, said sheet metal flue pipe section being comprised of a substantially flat piece of sheet metal rolled into cylindrical form and including means adjacent the edges of said piece for maintaining the same in cylindrical form;

a first end of said flue pipe section having a diameter substantially equal to the major portion of said section and the second end thereof being of reduced diameter adapted to fit within the first end of a similarly constructed flue pipe section;

a plurality of substantially circular holes formed in said flat piece of sheet metal, said holes being arranged such that for each hole there is a complementary hole in axial alignment therewith but located one hundred eighty degrees therefrom, and a plurality of cylindrically shaped metal pipes, each of said metal pipes being located between one of said holes and one of said complementary holes and being in substantial alignment with the others of said pipes, said metal pipes being substantially hollow and being open at each end but otherwise having solid cylindrical walls with no openings therein, the outer diameter of each of said pipes being substantially equal to the diameter of said holes so that said pipes may be force fit into said holes and securely held by said sheet metal around said holes, the length of said pipes being greater than the diameter of said flue pipe section so that the ends of said pipes extend outside of said flue pipe section, whereby hot gases and smoke passing through the flue pipe heats the metal pipes which in turn heats the air within the metal pipes which passes therefrom to heat the room wherein the flue is located.

* * * * *